United States Patent [19]

Kashimura

[11] Patent Number: 4,772,007

[45] Date of Patent: Sep. 20, 1988

[54] CUT SHEET HOLDING AND FEEDING APPARATUS

[75] Inventor: Makoto Kashimura, Tokyo, Japan

[73] Assignee: Canon Kabushiki Kaisha, Tokyo, Japan

[21] Appl. No.: 787,380

[22] Filed: Oct. 15, 1985

[30] Foreign Application Priority Data

| | | | |
|---|---|---|---|
| Oct. 19, 1984 | [JP] | Japan | 59-219433 |
| Oct. 19, 1984 | [JP] | Japan | 59-219439 |
| Dec. 14, 1984 | [JP] | Japan | 59-263032 |
| Jul. 19, 1985 | [JP] | Japan | 60-159480 |

[51] Int. Cl.[4] ..... B65H 3/30; B41J 11/58

[52] U.S. Cl. ..... 271/22; 271/127; 271/157; 271/171; 400/625; 400/633.2

[58] Field of Search ..... 271/160, 170, 171, 127, 271/22, 126, 127, 145, 157, 162, 164, 9; 400/624, 625, 629, 630–633.2

[56] References Cited

U.S. PATENT DOCUMENTS

| | | | |
|---|---|---|---|
| 3,599,971 | 8/1971 | Morioka | 271/162 X |
| 3,689,064 | 9/1972 | Kuksa | 271/127 |
| 3,807,725 | 4/1974 | Bookless | 271/171 |
| 4,032,136 | 6/1987 | Komaba et al. | 271/171 X |
| 4,034,975 | 7/1977 | Agnew et al. | 271/127 |
| 4,106,763 | 8/1978 | Tani et al. | 271/127 |
| 4,269,407 | 5/1981 | Tsuda et al. | 271/127 |
| 4,319,742 | 3/1982 | Ulseth | 271/127 |
| 4,406,448 | 9/1983 | Kulpa et al. | 271/127 |
| 4,429,863 | 2/1984 | Itoh et al. | 271/127 |
| 4,595,191 | 6/1986 | Uchiyama et al. | 271/170 |

FOREIGN PATENT DOCUMENTS

| | | | |
|---|---|---|---|
| 0198231 | 11/1984 | Japan | 271/160 |

*Primary Examiner*—Joseph J. Rolla
*Assistant Examiner*—Gregory L. Huson
*Attorney, Agent, or Firm*—Fitzpatrick, Cella, Harper & Scinto

[57] ABSTRACT

This specification discloses a cut sheet loading device in a cut sheet holding and containing device used in a recording apparatus such as a printer or a copying apparatus. The cut sheet holding and containing device of the present invention has an intermediate plate supported for vertical movement and loading and holding cut sheets thereon, a separating pawl provided so as to bear against the leading end of the cut sheets loaded on the intermediate plate and separating the cut sheets one by one, and an openable-closable cover covering the cut sheets loaded on the intermediate plate, the cut sheets being loaded onto the intermediate plate with the rear side of the openable-closable cover being opened, and is characterized in that a guide member for guiding the leading end portion of the cut sheets to the inside of the separating pawl when the cut sheets are loaded with the openable-closable cover being opened is projected or during the opening of the openable-closable cover, the intermediate plate and side guide are retracted to their positions in which they do not hamper the loading of the cut sheets.

16 Claims, 8 Drawing Sheets

CUT SHEET HOLDING AND FEEDING APPARATUS

BACKGROUND OF THE INVENTION

1. Field of the Invention

This invention relates to a cut sheet holding and containing device, and more particularly to a cut sheet loading device in a cut sheet holding and containing device used in a recording apparatus such as a printer or a copying apparatus.

2. Description of the Prior Art

A cut sheet holding and containing device loads paper sheets (recording paper sheets) cut into predetermined dimensions in a piled state thereon, the cut sheets being fed one by one into a recording station or the like, and is widely used in various types of recording apparatuses such as printers or copying apparatuses.

As the cut sheet holding and containing device, there has heretofore been proposed a cut sheet supply device of the type in which a paper supply roller is installed in a paper containing space surrounded by a pair of covers comprising an openable-closable cover (usually an upper cover or a front cover) and a fixed cover (usually a lower cover or a rear cover). A cut sheet holding intermediate plate (paper keeping plate) spring-biased toward the paper supply roller is provided between the paper supply roller and the fixed cover. A separating pawl bearing against the leading end portion of cut sheets is provided forwardly of the intermediate plate, and when the paper supply roller is rotated, the cut sheets are fed out while being separated one by one by the separating pawl.

When cut sheets are to be supplementally loaded into the cut sheet supply device of this type, the openable-closable cover (the dust-proof cover for protecting the contained recording paper sheets from the surrounding environment such as dust and moisture) may be opened, the intermediate plate may be depressed toward the fixed cover and moved away from the paper supply roller, a bundle of cut sheets may be inserted from therebetween and the leading end of the cut sheets may be positioned below the separating pal, whereafter the depression of the intermediate plate may be released and the openable-closable cover may be closed.

However, in the conventional cut sheet supply device of this type, where the cut sheets to be loaded are not flat but deformed, for example, where the marginal portion thereof is warped, there has occured a problem caused by the marginal portion striking against or being caught by the separating pawl,thus making it difficult or impossible to insert the cut sheets into a predetermined position.

Further, in the conventional cut sheet supply device of this type, where the cut sheets to be loaded are not flat but deformed, for example, where the marginal portion thereof is warped, there has occurred a problem in that during the loading of the cut sheets, the cut sheets strike against the paper supply roller or are pushed into that side opposite to the contact side of the paper supply roller, thus making it difficult or impossible to load the cut sheets into a predetermined position.

Also, in the conventional paper supply device of such a structure, when a bundle of recording paper sheets is to be newly loaded, there have been required the operations of opening the dust-proof cover, manually pushing back the paper keeping plate pressed by a spring and loading the bundle of paper sheets into the space between the paper keeping plate and the paper supply roller, and these operations have been very cumbersome.

SUMMARY OF THE INVENTION

It is an object of the present invention to provide a cut sheet holding and containing device into which cut sheets can be easily loaded.

More particularly, it is an object of the present invention to provide a cut sheet holding and containing device in which cut sheets can be easily loaded into a predetermined position while the leading end of the cut sheets is reliably guided to the inside of a separating pawl even in a case where the cut sheets are warped or otherwise deformed.

It is another object of the present invention to provide a cut sheet holding and containing device in which cut sheets can be easily inserted into the space between a paper supply roller and a cut sheet holding intermediate plate even in a case where the cut sheets are warped or otherwise deformed, whereby the cut sheets can be easily loaded into the device.

It is still another object of the present invention to provide a cut sheet holding and containing device in which a paper keeping plate (intermediate plate) or a side keeping member (side guide) does not hamper the loading of cut sheets.

That is, the cut sheet holding and containing device according to the present invention is provided with a guide member projecting so as to guide the leading end portion of cut sheets to the inside of separating means when the cut sheets are loaded with an openable-closable cover being opened, and therefore has an effect that the cut sheets can be easily loaded even in a case where the cut sheets are warped or otherwise deformed.

Also, the cut sheet holding and containing device according to the present invention is provided with a guide member projecting so as to guide the leading end portion of cut sheets to the contact side of a paper supply roller when the cut sheets are loaded with an openable-closable cover being opened, and therefcre has an effect that the cut sheets can be easily loaded even in a case where the cut sheets are warped or otherwise deformed.

Further, in the cut sheet holding and containing device according to the present invention, during the opening of the openable-closable cover, loading means and/or a side guide can be retracted to a position in which they do not hamper the loading of cut sheets, and the cumbersomeness with which the user manually holds down the cut sheets as required in the prior art is eliminated and the operability is remarkable improved, and this leads to the ease with which the cut sheets can be loaded into the device.

DESCRIPTION OF THE PREFERRED EMBODIMENTS

An embodiment of the present invention will hereinafter be described by reference to the drawings.

Figure 1:
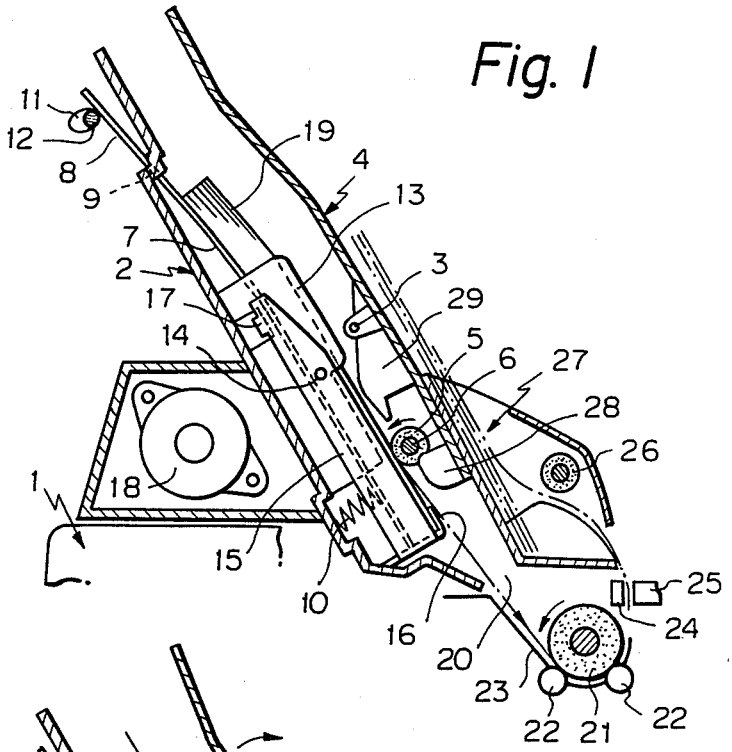
FIG. 1 is a longitudinal cross-sectional view showing the essential portions of a cut sheet supply device according to an embodiment of the present invention when it is used.

Referring to FIG. 1 which shows a cut sheet supplying device according to the present invention as it is used, a fixed cover 2 is attached to the body 1 of a recording apparatus (such as a printer), an openable-closable cover 4 pivotable (openable and closable) about a fulcrum 3 is mounted on the fixed cover, and two paper supply rollers 5 are installed in a space formed between the fixed cover and the openable-closable cover.

Figure 3:
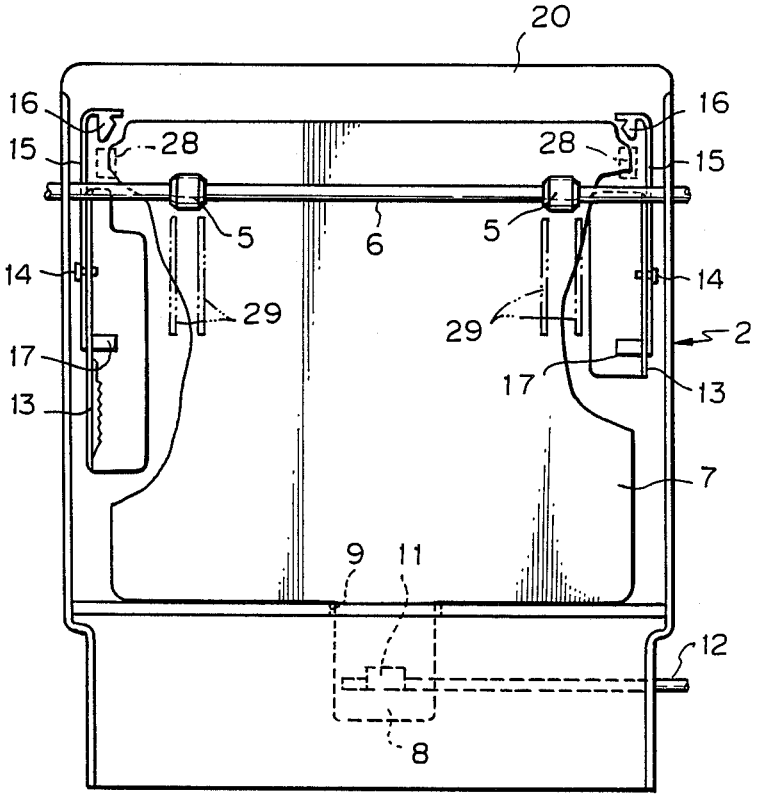
FIG. 3 is a plan view of the device of FIG. 1 with an openable-closable cover removed.

As best seen in FIG. 3, the two paper supply rollers 5 are installed at a predetermined interval and are rotatively driven through a roller shaft 6 journalled to the fixed cover 2.

In FIG. 1, a cut sheet holding intermediate plate 7 is provided between the paper supply rollers 5 and the fixed cover 2. This intermediate plate 7, as shown in FIGS. 1 and 3, has an ear 8 formed at the rear end thereof, and the ear 8 is inserted into a slot 9 in the rear central portion of the fixed cover 2 and is projected outwardly so that the intermediate plate is pivotable with the slot 9 as a fulcrum. This intermediate plate 7 is normally biased toward the paper supply rollers 5 by a spring 10 installed between the fore portion of the intermediate plate and the fixed cover 2. On the other hand, a cam 11 bearing against the ear 8 of the intermediate plate 7 is provided outside the rear portion of the fixed cover 2, as shown in FIGS. 1 and 3, and the intermediate plate 7 may be depressed with the slot 9 as a fulcrum by rotating the cam shaft 12 of the cam 11 by a lever operation. That is, by rotating the cam 11, the intermediate plate 7 can be depressed away from the paper supply rollers 5 against the force of the spring 10 and brought into the position of FIG. 2.

Figure 2:
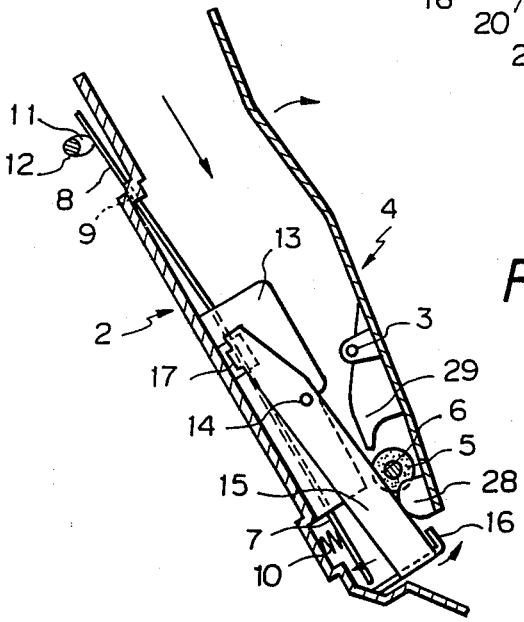
FIG. 2 is a longitudinal cross-sectional view showing the essential portions of the device of FIG. 1 when cut sheets are loaded thereinto.

As shown in FIGS. 1 and 3, width regulating plates 13 for regulating the width of cut sheets are provided on the opposite sides of the fixed cover 2, and a separating pawl supporting member 15 is pivotably mounted on each width regulating plate through a fulcrum 14. A separating pawl 16 adapted to bear against the leading end portion of loaded cut sheets is formed integrally with the fore end of each separating pawl supporting member 15. An ear 17 extending inwardly and engageable with the intermediate plate 7 is provided on each separating pawl supporting member 15 so that when the intermediate plate 7 is depressed to the position of FIG. 2, the intermediate plate may come into engagement with the ears 17 to pivot the separating pawls 16 upwardly as shown in FIG. 2.

The paper supply rollers 5 are driven only in the paper feeding direction by a step motor 18 mounted at a desired location in the recording apparatus, through a one-way clutch.

In FIG. 1, a plurality of piled cut sheets 19 are loaded between the paper feeding rollers 5 and the intermediate plate 7 while being urged by the spring force of the spring 10. The separating pawls 16 bear against the opposite edges of the upper surface of the fore end portion of the cut sheets 19.

During the supply of the cut sheets 19, when the paper supply rollers 5 are driven in the direction of the arrow, a thrust force is imparted to the uppermost cut sheet and the leading end portion of this cut sheet is urged against the separating pawls 16 and is separated outwardly of the separating pawls while forming a loop. The thus separated cut sheet 19 is fed into between a paper feeding roller 21 and a pinch roller 22 through a supply port 20. Reference numeral 23 designates a paper supply guide.

The cut sheet thus fed into the paper feeding mechanism is fed to the printing station between a platen 24 and a printing head 25 by the paper feeding roller 21, and printing (recording) is effected on the cut sheet 19 as it is fed by one line each.

The printed cut sheet 19 is fed into a paper. discharge tray 27 having a paper discharge roller 26.

When the cut sheets 19 have been consumed and replenishment thereof becomes necessary, as shown in FIG. 2, the openable-closable cover 4 is rotated and opened about the fulcrum 3 and at the same time, the cam 11 is rotated to depress the intermediate plate 7 toward the fixed cover 2 against the force of the spring 10 and move the intermediate plate away from the paper supply rollers 5 to thereby permit cut sheets 19 to be inserted therebetween. At this time, the separating pawls 16 are rotated about the fulcrum 14 by the intermediate plate 7 and displaced upwardly.

According to the present invention, guide members 28 are projectedly provided on the opposite sides of the inner surface of the openable-closable cover 4 and near the rear of the separating pawls 16. These guide members 28 are provided at positions for guiding the leading end portion of cut sheets 19 toward the inner sides of the separating pawls 16 (toward the intermediate plate 7) when the cut sheets 19 are to be loaded with the openable-closable cover 4 being opened. The positions on the plane at which these guide members 28 are provided on the opposite sides are indicated by dots-and-dash lines in FIG. 3.

Further, second guide members 29 are projectedly provided on the inner surface of the openable-closable cover 4 and near the rear of the paper supply rollers 5. The second guide members 29 are provided at positions for guiding the leading end portion of cut sheets 19 toward the contact side of said paper supply rollers 5, i.e., toward the intermediate plate 7, when the cut sheets 19 are to be loaded with the openable-closable cover 4 opened. The positions of these second guide members on the plane are indicated by dots-and-dash lines in FIG. 3.

The guide members 28 and the second guide members 29 can be formed integrally with the openable-closable cover 4 which is usually a plastic molding, or alternatively, they may be provided by fixed plastic or metallic single parts.

According to the above-described embodiment, the guide members 28 are projectedly provided near the rear of the separating pawls 16 and therefore, by a very simple structure, it is possible to insert cut sheets 19 into a predetermined location inside the separating pawls 16 when the cut sheets 19 are to be loaded. Particularly, where the marginal portion of the cut sheets 19 is warped or otherwise deformed, a great effort to load the cut sheets has been required or the loading of the cut sheets has been impossible with the structure according to the prior art, whereas according to the structure of the present embodiment, cut sheets can be loaded easily and reliably even in such a case.

Further, according to the above-described embodiment, the second guide members 29 are projectedly provided near the rear of the paper supply rollers 5 and therefore, by a very simple structure, it is possible to prevent the inconvenience that during the loading of cut sheets, the leading end of the cut sheets strikes against the paper supply rollers 5 or the cut sheets are wrongly inserted through the opposite side of the paper supply rollers, and from this point as well, the loading of cut sheets can be accomplished easily and reliably. Particularly, where the cut sheets 19 are warped or otherwise deformed, the aforementioned said inconvenience has occurred with the structure according to the prior art, whereas according to the structure of the present embodiment, the cut sheets can be loaded easily and reliably even in such a case.

Another embodiment for achieving the objects of the present invention will now be described.

Figure 4:
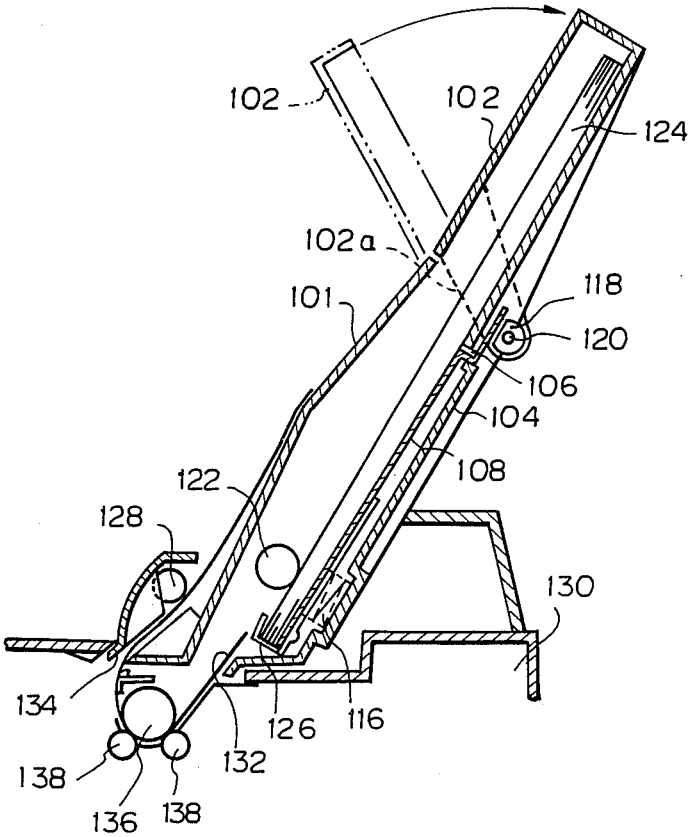
FIG. 4,is a longitudinal cross-sectional side view.

Referring to FIG. 4 and so on which illustrate an embodiment of the present invention, a cut sheet supply device generally designated by 101 is formed into a flat housing, and the intermediate bent portion of an intermediate plate 108 is fitted through an opening 106 formed in the intermediate portion of the back plate 104 of the housing.

Figure 6:
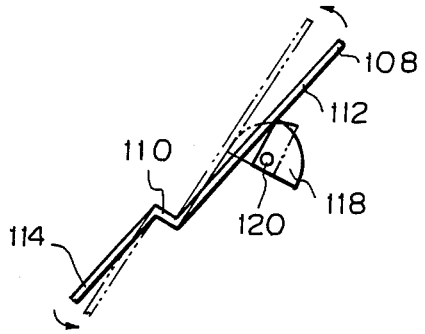
FIG. 6 illustrates the operation of a paper keeping plate.

The intermediate plate 108 is formed with a bent portion 110 bent at a right angle at the intermediate point thereof as shown in FIG. 6, and an upper half 112 from the bent portion 110 is disposed on the back surface of a back plate 104 and a lower half 114 from the bent portion 110 is disposed on the upper surface of the back plate 104, and the bent portion 110 is fitted in said opening 106.

A spring 116 is resiliently provided between the lower half of the intermediate plate 108 and the back plate 104, and by the spring 116, the intermediate plate 108 is urged toward a paper supply roller 122 rotatably supported on a shaft 122*a* transversely mounted in the paper supply device.

The intermediate plate 108 has its lower half 114 normally pushed upwardly as indicated by solid lines in FIG. 6.

On the other hand, on the back side of the back plate 104, a release cam 118 is rotatably supported by a shaft 120.

The release cam 118 constitutes interlocking position control means for the intermediate plate 108 and is of a semi-circular shape, for example.

Cams 117 which are means for controlling the positions of the side edges of the recording paper or the like as will later be described are provided on the opposite ends of the shaft 120 and further, an openable-closable (dust-proof) cover 102 constituting the upper half of the paper supply device is pivotably supported on the shaft 120.

Figure 5:
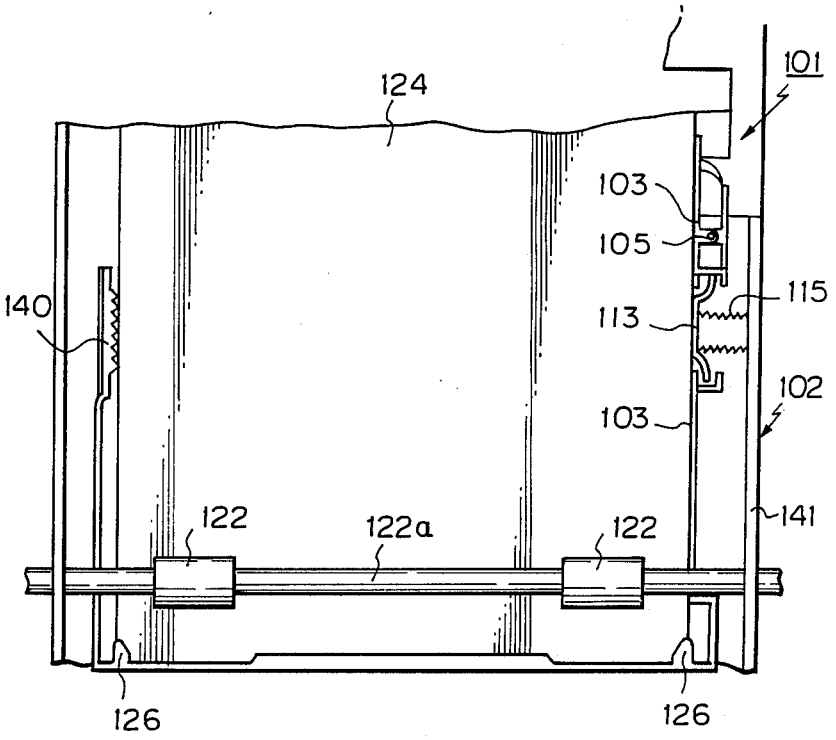
FIG. 5 is a plan view with the cover removed.
Figure 7:
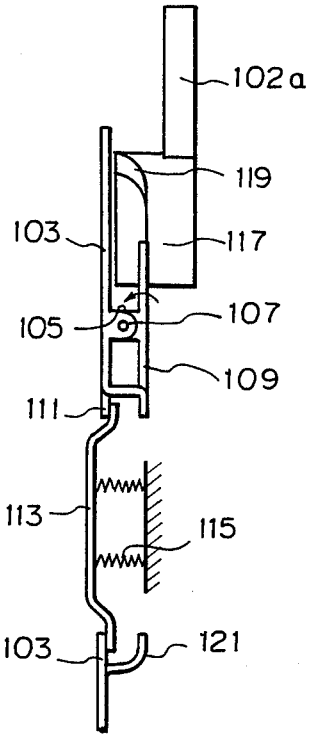
FIG. 7 is a plan view of a side keeping mechanism.

On the other hand, a fixed member 103 is mounted on the intermediate portion of the side edge of the paper supply device, as shown in FIGS. 5 and 7.

A projection 105 is provided on a portion of the fixed member 103, and a pivotable member 109 is pivotably supported on the projection 105 through a shaft 107.

Figure 8:
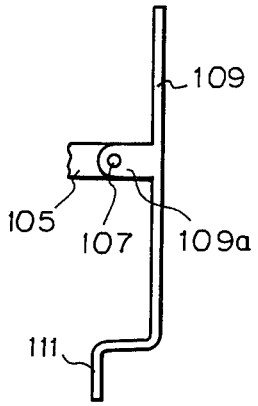
FIG. 8 is a plan view of a pivotable member.

The pivotable member 109 has a projection 109*a* on the intermediate portion thereof as shown in FIG. 8, and is pivotally connected to said projection 105 through the projection 109*a* and by means of the shaft 107.

A hook 111 is provided at the lower end of the pivotable member 109, and a side keeping member 113 is mounted between the hook 111 and the lower end of the fixed member 103.

The side keeping member 113 is pressed by a spring 115 resiliently provided between it and the fixed portion of the paper supply device.

The upper end of the pivotable member 109 is in contact with the cam surface 119 of a cam 117 fixed to the openable-closable cover 102.

Figure 10:
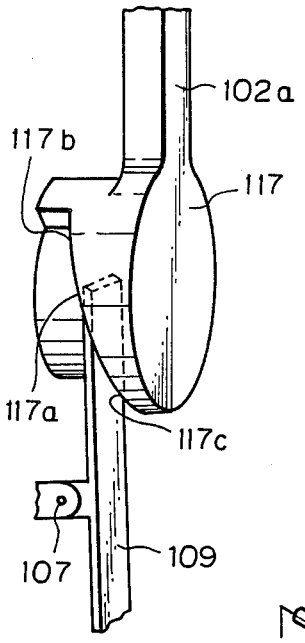
FIGS. 10 and 11 are perspective views illustrating the shape and operation of a cam.
Figure 11:
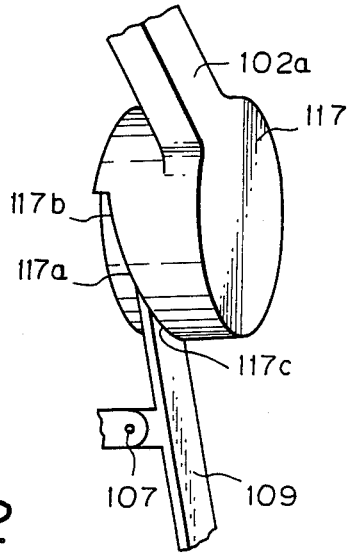

That is, the cam 117 is fixed to at least ore arm 102*a* of the openable-closable cover 102, as enlargedly shown in FIGS. 10 and 11.

The cam 117 may be provided integrally with or separately from the arm 102*a*.

This cam 117 is formed with a cam surface 117*a* over the half or more periphery of the side surface thereof, and this cam surface 117*a* is an inclined surface having the lowest portion 117*b* at a location near the openable-closable cover 102 and the highest portion 117*c* at a location spaced apart from the openable-closable cover 102, as shown in FIG. 10.

As shown in FIGS. 10 and 11, one end of the pivotable member 109 is in contact with the cam surface 117*a*.

Figure 12:
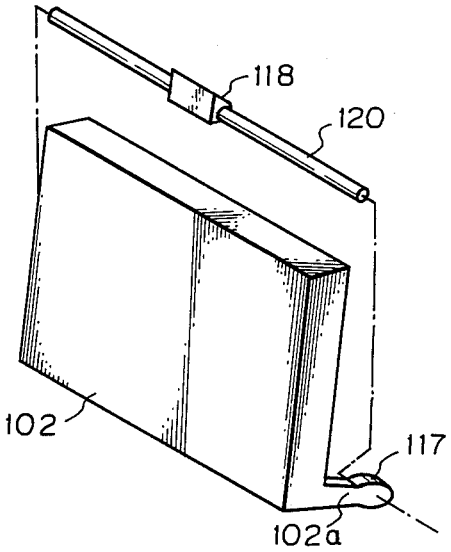
FIG. 12 is a perspective view of a dust-proof cover.

A release cam 118 is fixed to the intermediate portion of a shaft 120 which pivotally supports the arm 102*a* through the cam 117 (see FIG. 12).

Accordingly, when the openable-closable cover 102 is pivotally moved, the pivotable member 109 is pivotally moved through the cam 117.

Cut sheets (recording paper) 124 are piled on the back plate 104 and intermediate plate 108 of the paper supply device 101. The lower end portion of the cut sheets 124 is supported by a separating pawl 126, and the cut sheets 124 fed out one by one by a paper supply roller 122 are directed through a paper supply port 132 to between a paper feeding roller 136 and pinch rollers 138 provided on the body 130 side of the recording apparatus or the like and are discharged from a paper discharge port 134 by a paper discharge roller 128.

In FIG. 5, reference numeral 140 designates a guide member for cut sheets 124 and reference numeral 141 denotes a side plate.

Designated by 121 in FIG. 7 is a hook projectedly provided on the fixed member 103.

Operation of the present embodiment constructed as described above will now be described.

The intermediate plate 108 is normally in the position indicated by solid lines in FIG. 6 and the side keeping member 113 is pressed by the spring 115 as shown in FIG. 7, and it is projected slightly inwardly of the fixed member 103 as shown in FIG. 7 when cut sheets are not loaded.

When it is desired to load cut sheets, the upper end portion of the paper supply device is widely opened if the openable-closable cover 102 is pivoted counter-clockwise about the shaft 120 as viewed in FIG. 4.

At this time, the release cam 118 also rotates and by the cam surface thereof, the intermediate plate 108 is pivoted counter-clockwise as indicated by dot-and-dash lines in FIG. 6.

As a result, the lower half 114 of the intermediate plate 108 becomes separate from the paper supply roller 122 and a space is formed between it and the paper supply roller to thereby permit a bundle of cut sheets to be loaded.

Figure 9:
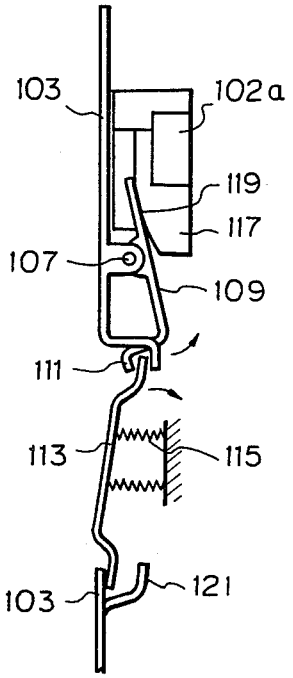
FIG. 9 is a plan view illustrating the operation of the side keeping mechanism.

With the pivotal movement of the openable-closable cover 102, the cam 117 integral therewith also rotates and the cam surface 119 pushes the pivotable member 109, so that the pivotable member 109 is pivoted counter-clockwise about the shaft 107 as shown in FIG. 9.

At this time, the upper end portion of the side keeping member 113 engaged by the hook 111 of the pivotable member 109 overcomes the force of he spring 115 and is pushed to the right as viewed in FIG. 9.

As a result, the side keeping member 113 is moved outwardly of the fixed member 103 and thus, the side keeping member does not obstruct the loading of cut sheets.

When the loading of cut sheets 124 is terminated, the openable-closable cover 102 is returned to its original position and closed, but in this state, the intermediate plate 108 is pressed by the force of the spring 116 provided on the lower portion of the lower half 114 of the intermediate plate 108 and the cut sheets 124 are urged against the paper supply roller 122.

Also, when the openable-closable cover 102 is closed, the pressure force to the pivotable member 109 by the cam 117 is released and therefore, the side keeping member 113 is returned to its original state by the force of the spring 115 and can reliably hold down the side edges of the cut sheets 124.

In this state, the paper supply roller 122 and others are driven by drive means, not shown, and the cut sheets are supplied one by one to the outside of the device.

Another embodiment of the present invention will hereinafter be described by reference to the drawings.

Figure 13:
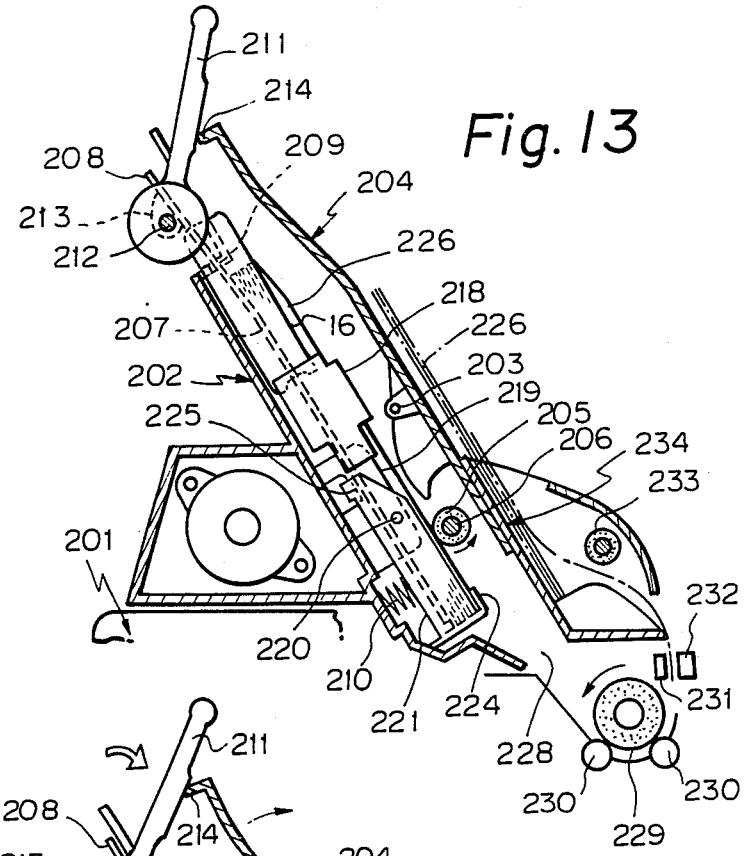
FIG. 13 is a longitudinal cross-sectional view showing the essential portions of another embodiment of the present invention.

FIG. 13 shows a cut sheet supply device according to the present embodiment of the present invention as it is used. The cut sheet supply device is removably set on the body 201 of a recording apparatus (such as a printer).

In the cut sheet supply device, a front cover 204 is openably-closably (pivotably) mounted on a fixed cover 202 through a fulcrum 203, and two paper supply rollers 205 are supported on the fixed cover 202 and disposed in the space between these cover 202 and 204.

Figure 15:
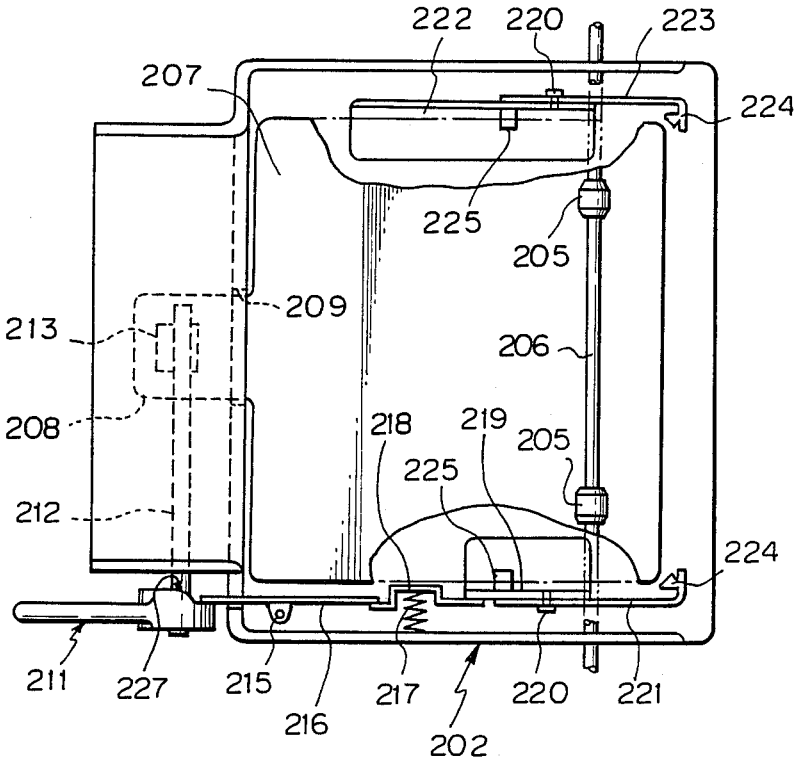
FIG. 15 is a plan view showing a state in which an openable-closable cover has been removed.

The two paper supply rollers 205 are installed at a predetermined interval as shown in FIG. 15 and may be driven through a roller shaft 206 supported on the fixed cover 202.

In FIGS. 13 and 15, a cut sheet holding intermediate plate 207 is provided between the paper supply rollers 205 and the fixed cover 202. This intermediate plate has an ear 208 formed on the rear end thereof, the ear 208 being inserted in a slot 209 in the rear central portion of the fixed cover 202 and projected outwardly, and is pivotably mounted with the slot 209 as a fulcrum. The intermediate plate 207 is normally biased toward the paper supply rollers 205 by a spring 210 provided between the fore portion of the intermediate plate and the fixed cover 202.

On the other hand, a cam shaft 212 rotatively perated by a lever 211 is supported on the rear portion of the fixed cover 202.

A cam 213 bearing against the ear 208 of the intermediate plate 207 is provided on the cam shaft 212, and by operating the lever 211, the intermediate plate 207 may be depressed with the slot 209 as a fulcrum. That is, by the lever 211, the intermediate plate 207 can be moved away from the paper supply rollers 205 against the force of the spring 210 to the position of FIG. 14.

Figure 14:
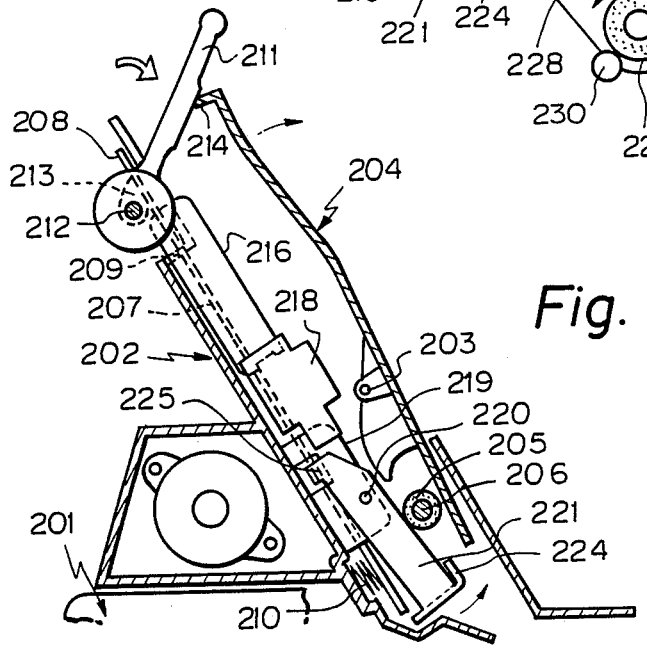
FIG. 14 is a longitudinal cross-sectional view showing the essential portions during the loading of cut sheets.

The lever 211 is mounted so as to be capable of contacting the projection or engaging portion 214 on the rear of the front cover 204, and by the pivotal operation thereof, the front cover 204 can be opened into the state of FIG. 14. That is, the front cover 204 can be opened as soon as the lever 211 is operated to depress the intermediate plate 207 by the cam 213.

In FIGS. 13 and 15, on one side of the fixed cover 202 (that side adjacent to the lever 211), there are provided a release arm 216 pivotable about a vertical shaft 215, a side keeping member 218 biased inwardly laterally by a spring 217 and regulating the side edge of cut sheets, a support plate 219 fixed to the fixed cover 202, and a separating pawl member 221 vertically pivotably supported on the support plate 219 through a pin 220.

A paper width regulating plate 222 is fixed to the other side of the fixed cover 202 (that side opposite to the lever 211), and a separating pawl member 223 symmetrical with the separating pawl member 221 is supported on the paper width regulating plate 222 through the pin 220.

A separating pawl 224 cooperable with the paper supply rollers 205 to separate cut sheets one by one from the uppermost layer is formed on the fore end of each of the separating pawl members 221 and 223. An ear 225 extending inwardly and engageable with the intermediate plate 207 is formed on the rear end portion of each of the separating pawl members 221 and 223 so that when the intermediate plate 207 is depressed as shown in FIG. 14, the separating pawls 224 and 224 are upwardly pivoted in response thereto.

In FIG. 13, reference numeral 226 designates a bundle of loaded cut sheets.

Figure 16:
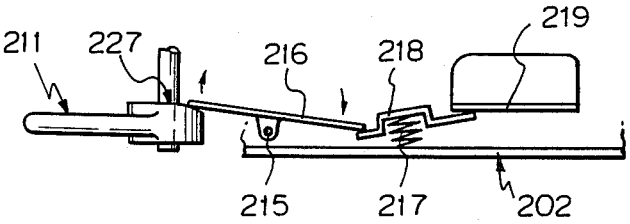
FIG. 16 is a plan view of a side keeping mechanism.

An end surface cam 227 is formed on the boss portion of the lever 211 as shown in FIGS. 15 and so that when the lever 211 is pivoted clockwise as viewed in FIG. 14, the release arm 216 can be pivoted about a support shaft 215 in the direction of the arrow (clockwise direction) indicated in FIG. 16 and the side keeping member 218 can be moved away from the side edge of the cut sheets against the force of the spring 217 as shown in FIG. 16.

That is, by operating the lever 211, the intermediate plate 207 can be depressed and the front cover 204 can be opened and at the same time, the side keeping member 218 can be retracted.

During the supply of cut sheets 226, when the paper supply rollers 205 are driven in the direction of the arrow in the state of FIG. 13, the uppermost one of the cut sheets 226 is separated outwardly of the separating pawls 224 and 224 and fed into between a paper feeding roller 229 and pinch rollers 230 through a supply port 228.

The cut sheet thus supplied to the paper feeding mechanism is fed to the printing station between a platen 231 and a printing head 232 by the paper feeding roller 229.

The printed (recorded) cut sheet is fed into a paper discharge tray 234 by a paper discharge roller 233.

When the cut sheets 226 have been consumed and are to be replenished, the front cover 204 is opened and the intermediate plate 207 is depressed as shown in FIG. 14 while, at the same time, the side keeping member 218 is retracted as shown in FIG. 16. At the same time, the separating pawls 224 are moved to their upwardly retracted position.

After the automatic paper supply device has been thus operated to its open position, a bundle of cut sheets is inserted from above, whereafter the front cover 204 is held down from its outside or the lever 211 is pivoted to its original position, whereby the device is set to its closed position (loaded state), i.e., the paper supplying state of FIG. 13.

Thus, according to the above-described construction, all of the intermediate plate 207, the side keeping member 218 and the front cover 204 can be operatively associated with the lever 211 and all of these can be operated by an operation of the lever 211 and therefore, the operation of bringing the automatic paper supply device into its open position for the purpose of supplemental loading of cut sheets 226 or internal checkup can be accomplished very easily and reliably.

Also, the operation of returning the device from its open position to its original state can be accomplished very easily and reliably by one operation of depressing the front cover or pivoting the lever 211.

I claim:

1. A cut sheet holding device comprising:
loading means for loading cut sheets thereon;
an openable-closable cover covering the cut sheets loaded on said loading means;
side guide means for guiding side edges of the cut sheets when said openable-closable cover is closed; and
means for causing said side guide means to move away from the cut sheets when said openable-closable cover is opened.

2. A cut sheet holding and containing device according to claim 1 wherein pivotal movement of said openable-closable cover is converted into reciprocal rectilinear movement of said side guide means by the use of a cam and a cam follower.

3. A cut sheet holding and containing device according to claim 1 wherein said loading means is vertically movable and provision is made of an interlocking member for operatively associating the opening of said openable-closable cover with vertical movement of said loading means.

4. A cut sheet feeding apparatus comprising:
loading means for loading cut sheets thereon;
a rotating feed member for feeding the cut sheets;
an openable-closable cover covering the cut sheets loaded on said loading means; and
a guide member for guiding cut sheets introduced onto said loading means away from said rotating feed member, said guide member assuming a guide position when said cover is open, and assuming a non-guide position away from the cut sheets when said cover is closed.

5. A cut sheet feeding apparatus according to claim 4, wherein said guide member is disposed on said cover.

6. A cut sheet feeding apparatus according to claim 4, wherein said feeding apparatus comprises means for causing said loading means to leave said rotating feed member upon opening said cover.

7. A cut sheet feeding apparatus according to claim 4, wherein said loading means is inclined in such a condition that the loaded cut sheets are fed from a bottom side of the loading means.

8. A cut sheet feeding apparatus according to claim 4, wherein said feeding apparatus comprises a side guide for restraining side edges of the cut sheets loaded on said loading means, and means for causing the side guide to be withdrawn from the cut sheets upon opening said cover.

9. A cut sheet holding apparatus comprising:
loading means for loading cut sheets thereon;
a separation pawl for restraining the cut sheets;
an openable-closable cover covering the cut sheets loaded on said loading means; and
a guide member for guiding cut sheets introduced onto said loading means away from said separation pawl, said guide member assuming a guide position when said cover is open, and assuming a non-guide position away from the cut sheets when said cover is closed.

10. A cut sheet holding apparatus according to claim 9, wherein said guide member is disposed on said cover.

11. A out sheet holding apparatus according to claim 9, wherein said feeding apparatus comprises means for causing said loading means to leave said separation pawl when said cover is opened.

12. A cut sheet holding apparatus according to claim 9, wherein said loading means is inclined in such a condition that the loaded cut sheets are fed from a bottom side of the loading means.

13. A cut sheet holding apparatus according to claim 9, wherein said feeding apparatus further comprises a side guide for restraining side edges of the cut sheets loaded on said loading means, and means for causing said side guide to move away from the cut sheets when said cover is opened.

14. A cut sheet feeding apparatus comprising:
loading means for loading cut sheets thereon;
a rotating feed member for feeding the cut sheets;
separating means for restraining leading edges of the cut sheets loaded on said loading means;
an openable-closable cover covering the cut sheets loaded on said loading means; and
a guide member for guiding cut sheets introduced onto said loading means away from said rotating feed means and said separating means, said guide member assuming a guide position when said cover is open, and assuming a non-guide position away from the cut sheets when said cover is closed.

15. A cut sheet feeding apparatus according to claim 14, wherein said separating means moves away from the cut sheets when said openable-closable cover is opened.

16. A cut sheet feeding apparatus according to claim 14, wherein said loading means moves away from said separating means when said openable-closable cover is opened.

* * * * *

UNITED STATES PATENT AND TRADEMARK OFFICE

CERTIFICATE OF CORRECTION

PATENT NO. : 4,772,007

DATED : September 20, 1988

INVENTOR(S) : MAKOTO KASHIMURA

It is certified that error appears in the above-identified patent and that said Letters Patent is hereby corrected as shown below:

Column 1, line 43, "pal" should read --pawl--.

Column 5, line 27, "said" should be deleted.

Column 8, line 3, "perated" should read --operated--;

line 48, "15 and" should read --15 and 16--.

Signed and Sealed this

Seventeenth Day of January, 1989

*Attest:*

DONALD J. QUIGG

*Attesting Officer*

*Commissioner of Patents and Trademarks*